US006058638A

United States Patent [19]

Slåttebrekk

[11] Patent Number: 6,058,638

[45] Date of Patent: May 9, 2000

[54] INFORMATION HOLDER

[75] Inventor: Sigurd Slåttebrekk, Oslo, Norway

[73] Assignee: Alpin Media A/S, Oslo, Norway

[21] Appl. No.: 09/198,724

[22] Filed: Nov. 24, 1998

[51] Int. Cl.[7] ..... G09F 3/18; G09F 3/20

[52] U.S. Cl. ..... 40/654.01; 40/611; 40/661; 40/649

[58] Field of Search ..... 40/607, 611, 612, 40/661, 654.01, 653, 649

[56] References Cited

U.S. PATENT DOCUMENTS

| | | | |
|---|---|---|---|
| 2,124,025 | 7/1938 | Braun | 40/642.02 |
| 2,680,315 | 6/1954 | McHugh et al. | 40/653 X |
| 4,742,630 | 5/1988 | Scumaci | 40/607 X |
| 5,077,925 | 1/1992 | Herrera et al. | 40/611 X |

*Primary Examiner*—Terry Lee Melius
*Assistant Examiner*—Rodrigo J. Morales
*Attorney, Agent, or Firm*—Rodman & Rodman

[57] ABSTRACT

An information holder for an information slip has a receiver part and a sliding compartment. The receiver part has a transparent front portion and a back portion, with an elongated recess extending from a top end of the receiver part to a bottom end of the receiver part, allowing the holder to be mounted to a pole or other device. The sliding compartment has an upwardly bent bottom portion to hold the information slip and configured to shield the slip from water. Drainage holes extend from the lower portion of the sliding compartment through the bottom end of the receiver part to allow water to drain from the holder. An eaves-like overhang on the sliding compartment is configured to protect the information slip from water entering through the top of the holder. Two slanted side portions allow water to run off the sides of the holder.

4 Claims, 2 Drawing Sheets

INFORMATION HOLDER

The present invention relates to an information holder for securely retaining an information slip on a pole or a vertical surface, preferably for use on a pole in connection with a T-bar on a ski tow, a chair in a chair lift or the like, comprising a receiver part for placement on the pole or surface and a sliding compartment for information slips, where the receiver part is provided with a transparent cover, which together with the rest of the receiver part forms a pocket, and the sliding compartment for information slips is adapted for capability to be placed in the pocket and securely hold the information slip so that it is visible through the cover.

From U.S. Pat. No. 1,575,949 has been made known a tag/emblem holder which consists of a holding plate, in which a pocket is formed. The front face of the pocket is formed by a transparent plate. A tag is designed for placement in the pocket behind the transparent plate. It is not explained in detail how the tag is to be exchanged with a new tag, but this is probably due to the fact that the holder is intended to hold emblems and similar items on a more or less permanent basis. If the tag were to be replaced by another tag, however, the replacement process would presumably have to be quite involved.

From GB 2,116,141 is known a holder for a vehicle license/registration, which consists of a main part and a cover part. The two parts are able to be pressed together. This apparatus, however, does not ensure protection against penetration of water for the simple reason it is intended for placement on the inside of a vehicle window.

It is therefore an objective of the present invention to provide a holder for information slips which guards against penetration of water, at the same time as it offers an easy way to change the information slips. This is achieved by providing the information slip compartment with an eaves-like overhang, which projects over the edge of the cover at the open end of the pocket when the information slip compartment is inserted in the pocket, and thereby prevents falling water from flowing down into the pocket, and by providing the information slip compartment at the end thereof facing the bottom of the pocket with a bent-back portion, which securely holds the information slip and prevents water from coming into contact with the information slip from below.

Figure 1:
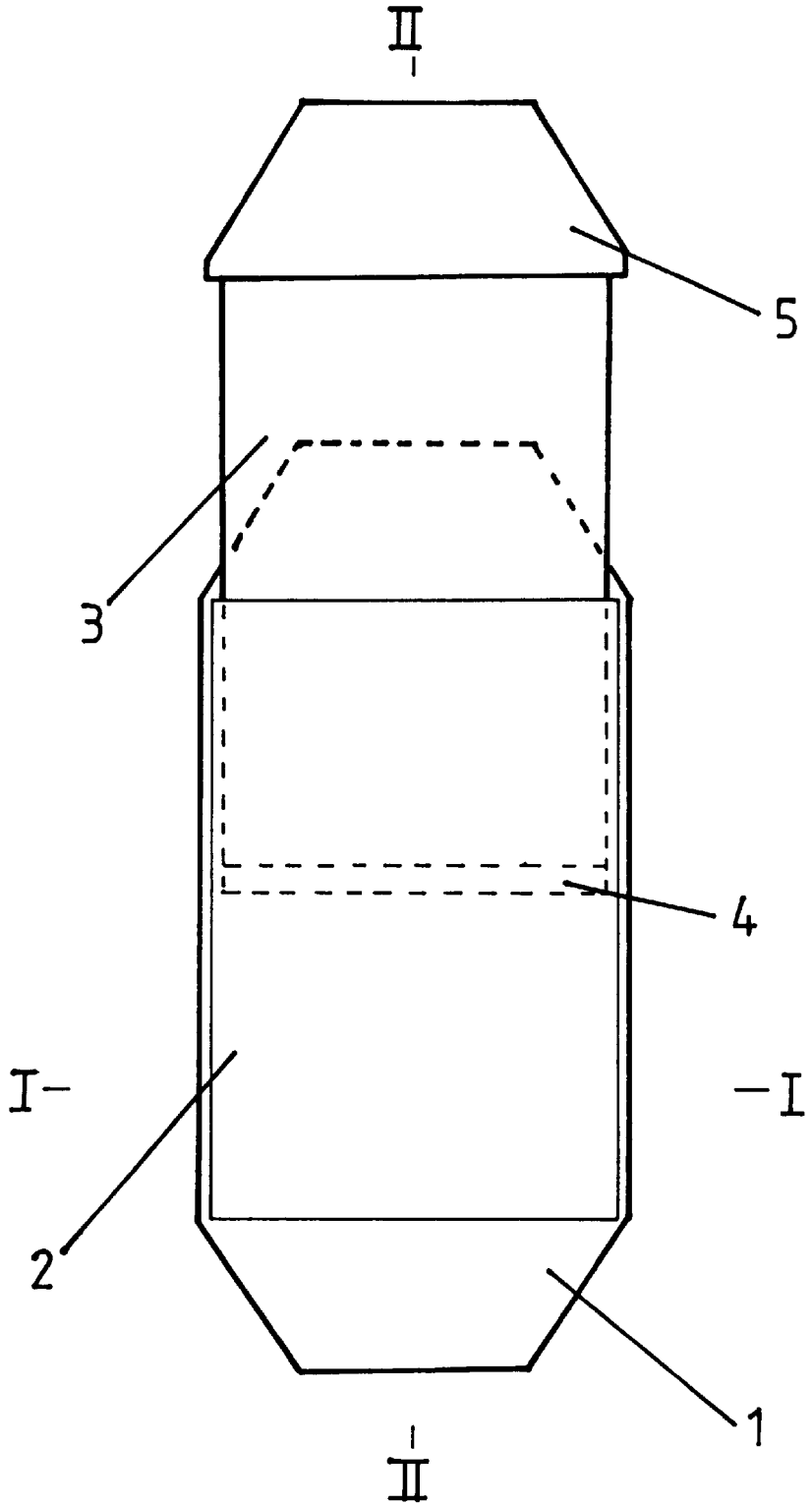
Figure 3:
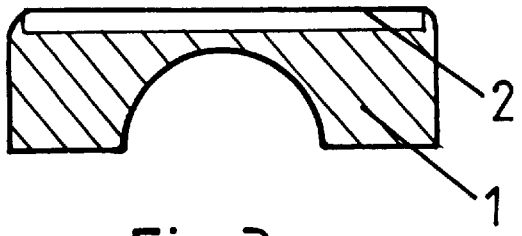
Figure 2:
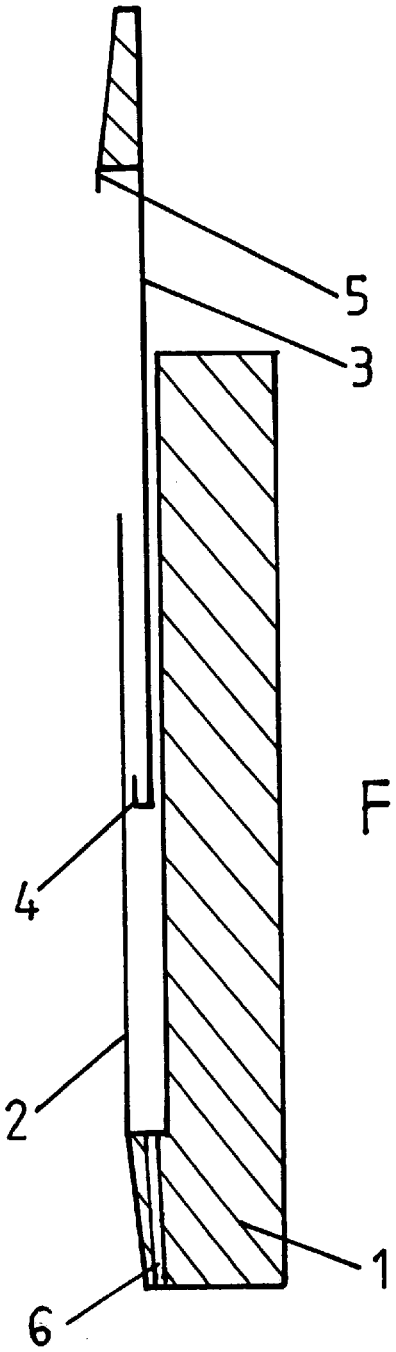

The invention will now be explained in further detail with reference to the accompanying drawings, wherein FIG. 1 is a front view of the holder according to the invention, FIG. 2 shows a holder according to the invention in cross section along line II—II in FIG. 1, FIG. 3 shows a holder according to the invention in cross-section along line I—I in FIG. 1.

The information slip holder according to FIGS. 1–3 includes a receiver part 1, which is equipped with a cover 2. Between cover 2 and receiver part 1 is formed a pocket, which has an open upper end. To facilitate the mounting of receiver part 1 on a pole, there is formed a recess on the side thereof opposite cover 2.

A sliding compartment 3 for information slips, comprising an insertion part and a gripping part, is designed for capability to be lowered down into the pocket. The insertion part is provided with a bent-back portion 4, which is adapted to hold an information slip. The gripping part is provided at the lower edge thereof with an eaves-like overhang 5. When the information slip compartment 3 is lowered down into the pocket, overhang 5 will project out over the upper edge of the cover, so that water will not be able to penetrate into the pocket on the front side of compartment 3 and damage the information slip.

Any water that might seep down on the back side of compartment 3 will be prevented from coming into contact with the information slip by the bent-back portion 4. Drainage apertures 6 (FIG. 2) in the bottom of the pocket will ensure that water cannot accumulate in the bottom of the pocket.

The information slip may be easily replaced by drawing compartment 3 out of the pocket. The slip that is situated in compartment 3 may then be removed and a new one may be set down into the bent-back portion 4, whereafter compartment 3 is then slid down into the pocket again.

What is claimed is:

1. An information holder for an information slip comprising a receiver part provided with a transparent cover to define a pocket in the receiver part, the pocket having an upper open portion, a lower end portion that is closed, and closed side portions, a sliding compartment sized to be slideably received in the pocket through the upper end portion, said sliding compartment having an upwardly bent bottom portion corresponding to the lower end portion of the pocket, said upwardly bent portion being formed to support the information slip such that the information slip is visible through the transparent cover, said upwardly bent portion configured to shield the information slip from water, said sliding compartment having a top portion with an eaves-like overhang that overhangs the upper open portion of the pocket to deflect water away from the upper open portion of the pocket when the sliding compartment is accommodated in the pocket.

2. The information holder as claimed in claim 1 wherein the receiver part has a front portion that includes the pocket, a top end, a bottom end and a back portion opposite the pocket, said back portion being formed with an elongated recess extending from the top end to the bottom end to facilitate securement of the information holder to a pole.

3. The information holder as claimed in claim 1 wherein the receiver part has a top end, a front portion and a back portion, and opposite side portions between the front portion and back portion of said receiver part, and a slanted portion at the opposite sides extending from the top end to the respective side portions to facilitate water runoff.

4. The information holder as claimed in claim 1 wherein the receiver part has a bottom end, and drainage apertures are formed in said receiver part to extend from the lower end portion of the pocket through the bottom end of the receiver part.

* * * * *